United States Patent [19]

Harris

[11] 4,316,513

[45] Feb. 23, 1982

[54] NAIL DRIVING IMPACT HAMMER

[76] Inventor: Dwight Harris, 685 Maryland Ave., Washington, Pa. 15301

[21] Appl. No.: 118,573

[22] Filed: Feb. 4, 1980

[51] Int. Cl.[3] ..... B25C 5/06

[52] U.S. Cl. ..... 173/91; 227/113

[58] Field of Search ..... 173/90, 91, 121, 126; 227/113

[56] References Cited

U.S. PATENT DOCUMENTS

| | | | |
|---|---|---|---|
| 874,499 | 12/1907 | Gunn | 173/121 |
| 949,796 | 2/1910 | Howard | 173/126 X |
| 2,594,901 | 4/1952 | Forster | 173/91 X |
| 2,815,692 | 12/1957 | Daniels | 173/121 |
| 2,833,173 | 5/1958 | Aspeek | 173/121 X |
| 3,979,040 | 9/1976 | Denin | 227/113 |

FOREIGN PATENT DOCUMENTS

| | | | |
|---|---|---|---|
| 980072 | 4/1902 | France | 227/113 |
| 88174 | 8/1956 | Sweden | 227/113 |

*Primary Examiner*—Werner H. Schroeder
*Assistant Examiner*—Andrew M. Falik
*Attorney, Agent, or Firm*—William J. Ruano

[57] ABSTRACT

A reciprocating ram or hammer is disclosed for driving flat nails in mines without danger of creating sparks that might ignite inflammable gases that would cause an explosion. The hammer comprises a cylindrical tube in which a ram is reciprocated to strike an anvil or drive pin which pushes against a flat nail by overcoming the resistance of a helical spring in the tube. As the nail is being driven, it is held at the end of the hammer by a permanent magnet. Such flat nails are commonly driven overhead for suspending lines.

1 Claim, 1 Drawing Figure

NAIL DRIVING IMPACT HAMMER

Figure 1:
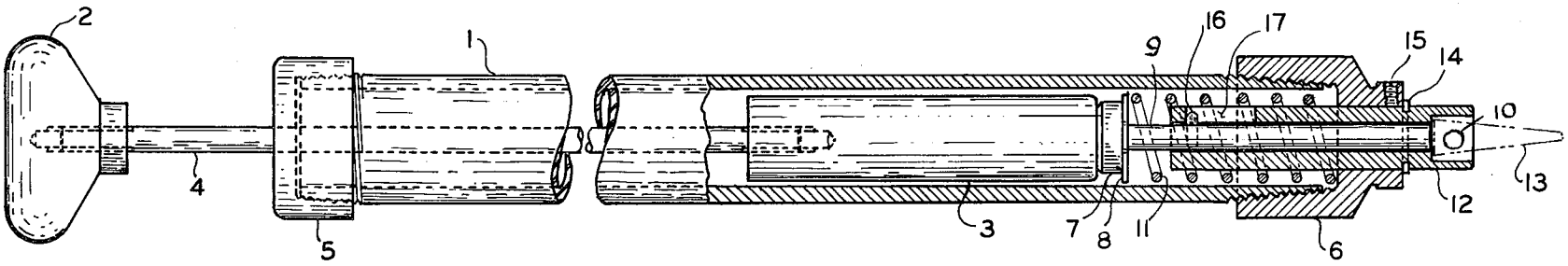

This invention relates to a hammer for use in driving nails in a mine without the danger of an explosion from sparks created by the hammer.

An outstanding disadvantage of commonly used ordinary hammers for driving nails in a mine is a constant danger of forming a spark by the impact of the hammer which may ignite a combustible gas, such as methane, generally present in a mine so as to cause an explosion.

An object of my invention is to overcome the above-named disadvantage by providing a hammer or ram rod which is enclosed so as not to expose sparks developed to the outside atmosphere.

Other objects and advantages of my invention will become more apparent from a study of the following description taken with the accompanying drawing wherein:

The single FIG. 1 is an elevational view, partly in vertical cross-section and shown broken away, of a hammer embodying the principles of my invention.

Referring more particularly to FIG. 1 numeral 1 denotes a cylindrical tube or housing and a numeral 2 denotes a ram operating knob or handle rigidly connected to a heavily weighted ram 3 by means of a ram rod 4. A cup-shaped end cap 5 has internal threads screw-threadedly connected to one end of tube 1 and a cup shaped end cap 6 has internal threads screw threadedly connected to the other end of tube 1.

An anvil or drive pin 7 is held by spring retaining washer 8 on one end of drive rod 9-the other end of which pushes against a flat nail or spud 13, shown in dot and dash outline and held inside of a well portion of a fastener tubular holder 12 by means of a permanent magnet 10 embedded in one side of the external well portion of holder 12 so as to magnetically attract and hold the magnetic nail 13 while it is being pushed by rod 9 into a mine beam, such as an overhead beam or the like.

A helical spring 11 has one end seated on washer 8 and the other end seated at the bottom of the cup shaped interior of end cap 6. A snap ring 14 holds holder 12 in place against the extremity of end cap 6, which end cap is locked against holder 12 by set screw 15. A roll pin 16 acts as a guide in slot 17 in a sleeve to keep the drive pin 7 in position.

In operation, when it is desired to drive the spud or flat nail 13 into a wooden beam or other object, knob 2 is recriprocated thereby reciprocating ram 13, causing it to strike against anvil 7 against the compression of spring 11, thereby gradually pushing the drive rod 9 which pushes against the enclosed end of nail 13. It will be particularly noted that any spark developed by the striking of ram 3 against anvil 7 will be totally enclosed by tube 1 and end caps 5 and 6 so as to not ignite methane or other explosive gas in the surrounding atmosphere. This particular construction facilitates hammering and enables hammering of spuds at very high elevations, even beyond the easy reach of the miner.

Thus it will be seen that I have provided a highly efficient, easily operable hammer that is useful in mines for hammering nails, particularly in high overhead positions, without the danger of creating a spark that might ignite the surrounding inflammable gases, such as methane, so as to cause an explosion.

While I have illustrated and described a single embodiment of my invention, it will be understood that this is by way of illustration only and that various changes and modifications may be contemplated in my invention and within the scope of the following claims.

I claim:

1. A reciprocating hammer for use in mines and the like comprising an elongated cylindrical tube, a cup-shaped end cap screw threaded to and closing the top of said tube, said end cap having a hole, a ram contained in said tube and having a rod extending through said hole and being operable by a knob externally of the tube, a second cup-shaped end cap screw threaded to the other end of said tube, and having a hole, a drive rod and surrounding sleeve extending through said last mentioned hole, an anvil supported by said drive rod, a spring surrounding said sleeve in said tube and having a free end biased against the bottom of said anvil, a well portion in the outer portion of said sleeve for holding said nail, and a permanent magnet embedded in said well portion of said sleeve for magnetically and stationarily holding the nail to be driven by reciprocation of said ram against said anvil, whereby sparks created between the ram and anvil will be totally enclosed by said cylindrical tube.

* * * * *